US010801082B2

(12) United States Patent
Hicks et al.

(10) Patent No.: US 10,801,082 B2
(45) **Date of Patent: *Oct. 13, 2020**

(54) MOLTEN METAL TREATMENT LANCE

(71) Applicant: J.W. Hicks, Inc., Merrillville, IN (US)

(72) Inventors: James R. Hicks, Valparaiso, IN (US); Matthew C. Smith, Valparaiso, IN (US); Kent M. Schonberger, Knox, IN (US)

(73) Assignee: J.W. Hicks, Inc., Merrillville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/930,714

(22) Filed: Nov. 3, 2015

(65) Prior Publication Data

US 2016/0053339 A1 Feb. 25, 2016
US 2016/0319384 A2 Nov. 3, 2016

Related U.S. Application Data

(63) Continuation of application No. 14/640,150, filed on Mar. 6, 2015, now Pat. No. 9,206,487.

(60) Provisional application No. 61/948,794, filed on Mar. 6, 2014.

(51) Int. Cl.
*F27D 3/16* (2006.01)
*C21C 5/46* (2006.01)
*C21C 7/00* (2006.01)

(52) U.S. Cl.
CPC ..... *C21C 5/4613* (2013.01); *C21C 5/4606* (2013.01); *F27D 3/16* (2013.01); *C21C 7/0037* (2013.01); *F27D 2003/169* (2013.01)

(58) Field of Classification Search
CPC ..... C21C 5/4606; F27D 3/16
USPC ..... 266/225
See application file for complete search history.

(56) References Cited

U.S. PATENT DOCUMENTS 3,082,997 A 3/1963 Kurzinksi
3,223,398 A 12/1965 Bertram et al.
3,379,428 A 4/1968 Dortenzo et al.
3,778,250 A 12/1973 Bernsmann
4,399,985 A 8/1983 Eastwood
4,438,907 A 3/1984 Kimura et al.
4,550,898 A 11/1985 LaBate, II
4,792,126 A 12/1988 Nagy et al.
(Continued)

OTHER PUBLICATIONS

Declaration of James R. Hicks, Jul. 10, 2015, 8 pages.

*Primary Examiner* — Scott R Kastler
(74) *Attorney, Agent, or Firm* — Barnes & Thornburg LLP

(57) ABSTRACT

A molten metal treatment lance includes a refractory having at least one channel extending through the refractory. A first tubular member having two open ends is located in the channel of the refractory. The first tubular member has a side wall having an inner surface and an outer surface. A second tubular member having an open end and a closed end is positioned in the first tubular member. The second tubular member has a side wall having an inner surface, an outer surface and at least one opening extending from the inner surface of the side wall of the second tubular member to the outer surface of the side wall of the second tubular member. The second tubular member is positioned in the first tubular member so as to form a space between the inner surface of the side wall of the first tubular member and the outer surface of the side wall of the second tubular member.

13 Claims, 7 Drawing Sheets

(56) References Cited

U.S. PATENT DOCUMENTS

| | | | | |
|---|---|---|---|---|
| 4,941,646 | A | 7/1990 | Stelts et al. | |
| 5,104,097 | A | 4/1992 | Naujokat et al. | |
| 5,198,179 | A | 3/1993 | Bates | |
| 5,547,170 | A | 8/1996 | Angeler et al. | |
| 5,820,816 | A | 10/1998 | Hicks | |
| 9,206,487 | B2 * | 12/2015 | Hicks | C21C 5/4606 |
| 2016/0053339 | A1 * | 2/2016 | Hicks | C21C 5/4606 266/225 |

* cited by examiner

MOLTEN METAL TREATMENT LANCE

CROSS-REFERENCE TO RELATED APPLICATIONS

The present application is a continuation of U.S. patent application Ser. No. 14/640,150, entitled "MOLTEN METAL TREATMENT LANCE," which was filed on Mar. 6, 2015, which claims the benefit of U.S. Provisional Patent Application No. 61/948,794 filed Mar. 6, 2014, each of which is incorporated herein by reference in its entirety.

The present invention relates to molten metal processing equipment and, in particular, to a molten metal treatment lance.

SUMMARY OF THE INVENTION

In one embodiment of the present invention, a treatment lance includes a refractory, a first tubular member and a second tubular member. The refractory has a first end with an opening therein, a second end with an opening therein, a first channel and a second channel. The first channel has a first end extending from the opening in the first end of the refractory to a second end located between the first end of the refractory and the second end of the refractory. The second channel has a first end extending from the second end of the first channel to the opening in the second end of the refractory. The second channel has a cross-sectional area smaller than the cross-sectional area of the first channel. The first tubular member is located at least partially within the channel of the refractory and has a first open end positioned outside the refractory and a side wall extending from the first open end to a second open end adjacent the second end of the first channel in the refractory. The side wall of the first tubular member defines a channel and has an inner surface and an outer surface. The second tubular member has a first end and a side wall extending from the first end of the second tubular member to a second closed end of the second tubular member. The second end of the second tubular member is located between the first end of the refractory and the second end of the first tubular member. The side wall of the second tubular member defines a channel and has an inner surface and an outer surface. The second tubular member is positioned at least partially within the channel of the first tubular member so as to form a space between the inner surface of the side wall of the first tubular member and the outer surface of the side wall of the second tubular member. The second tubular member has at least one opening extending through the side wall of the second tubular member to create a flow path from the channel of the second tubular member to the space between the inner surface of the side wall of the first tubular member and the outer surface of the side wall of the second tubular member.

In one embodiment, the first tubular member and the second tubular member have the same cross-sectional configuration. The first tubular member and the second tubular member may have a circular cross-section or a square cross-section in certain embodiments.

In another embodiment, the first tubular member and the second tubular member have different cross-sectional configurations. In one embodiment, the first tubular member has a square cross-section. In one embodiment, the second tubular member has a circular cross-section.

In another embodiment of the present invention, a treatment lance includes a refractory, a first tubular member and a second tubular member. The refractory has a first end, a second end with an opening therein and a channel extending from the first end to the opening in the second end. The first tubular member has a first end, a second end and a side wall extending between the first and second ends and defining a channel. The side wall has an inner surface and an outer surface. The second tubular member has a first end, a second closed end and a side wall extending between the first and second ends and defining a channel. The side wall has an inner surface, an outer surface and at least one opening extending from the inner surface to the outer surface. The second tubular member is positioned at least partially within the channel of the first tubular member such that the second end of the second tubular member is located between the first end of the refractory and the second end of the first tubular member.

In one embodiment, the second end of the first tubular member is located in the channel of the refractory between the first and second ends of the refractory.

In another embodiment, the second end of the second tubular member is located between the first and second ends of the refractory.

In one embodiment, the channel in the refractory has a first section having a first cross-sectional area and a second section having a second cross-sectional area. In one embodiment, the cross-sectional area of the first section of the channel in the refractory is greater than the cross-sectional area of the second section of the channel in the refractory.

In another embodiment, the first section of the channel in the refractory extends from the first end of the refractory to a location between the first and second ends of the refractory. In another embodiment, the second section of the channel in the refractory extends from a location between the first and second ends of the refractory to the opening in the second end of the refractory.

In one embodiment, the second tubular member is positioned at least partially within the channel of the first tubular member so as to form a space between the inner surface of the side wall of the first tubular member and the outer surface of the side wall of the second tubular member. In another embodiment, the treatment lance includes a flow path from the channel of the second tubular member, to the space between the inner surface of the side wall of the first tubular member and the outer surface of the side wall of the second tubular member, to the channel of the refractory and to the opening in the second end of the refractory.

In another embodiment of the present invention, a treatment lance includes a refractory and a tubular member. The refractory has a first end, a second end with an opening therein and a channel extending from the first end to the opening in the second end. The tubular member has a first end, a second closed end and a side wall extending between the first and second ends and defining a channel. The side wall has an inner surface, an outer surface and at least one opening extending from the inner surface to the outer surface to create a flow path from the channel of the tubular member to the opening in the second end of the refractory.

In one embodiment, the second end of the tubular member is located in the channel of the refractory.

In another embodiment, the treatment lance includes a second tubular member located at least partially in the channel of the refractory. The second tubular member has a channel in which the tubular member is at least partially located. In one embodiment, the second tubular member has a first end and a second end located in the channel of the refractory between the first and second ends of the refractory and the second end of the tubular member is located between the first end of the refractory and the second end of the second tubular member.

In another embodiment of the present invention, a treatment lance includes a refractory, a first tubular member and a second tubular member. The refractory has a first end, a second end with an opening therein and a channel extending from the first end to the opening in the second end. The first tubular member is located at least partially within the channel of the refractory and has a first end and a side wall extending from the first end to a second end having an opening therein. The side wall of the first tubular member defines a channel and has an inner surface and an outer surface. The second tubular member has a first end, a second closed end and a side wall extending between the first and second ends and defining a channel. The side wall has an inner surface and an outer surface. The treatment lance further includes means for permitting a gas introduced into the channel of the second tubular member to flow from the channel of the second tubular member to the opening in the second end of the refractory.

In one embodiment, the means for permitting gas to flow to the opening in the second end of the refractory includes at least one opening in the side wall of the second tubular member. In another embodiment, the means for permitting gas to flow to the opening in the second end of the refractory includes a space between the inner surface of the side wall of the first tubular member and the outer surface of the side wall of the second tubular member.

These and other features of the present invention will be apparent to those skilled in the art from the following description and accompanying figures.

DETAILED DESCRIPTION OF EMBODIMENTS OF THE INVENTION

Figure 1A:
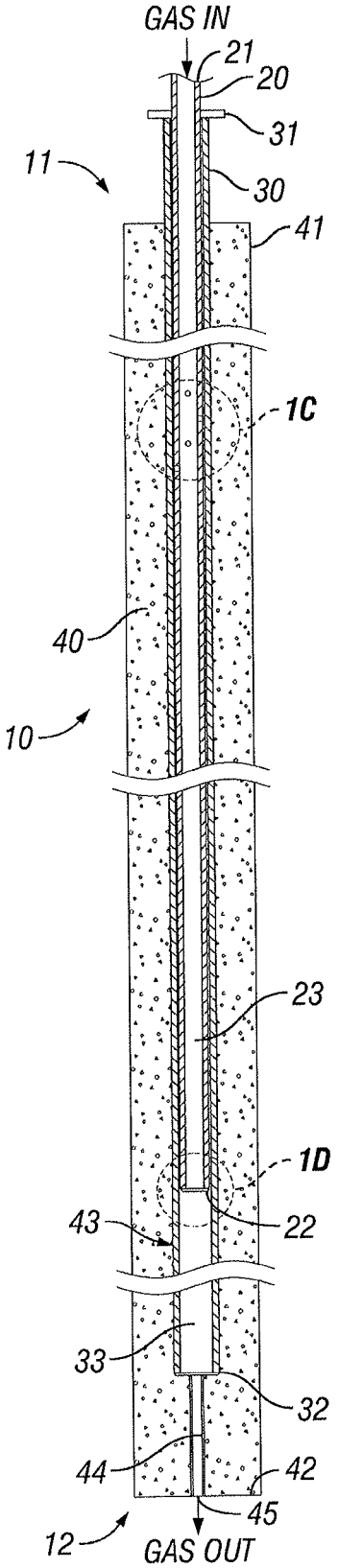
FIG. 1A is a longitudinal sectional view of a molten metal treatment lance according to one embodiment of the present invention.
Figure 1B:
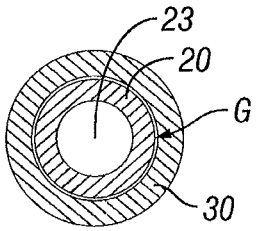
FIG. 1B is a cross-sectional view taken along line A-A in FIG. 1A.

Referring to FIGS. 1A-1D, a molten metal treatment lance 10 generally includes an inner tube 20 and an outer tube 30 housed within a refractory 40. Lance 10 includes a first end 11 and a second 12.

Figure 1C:
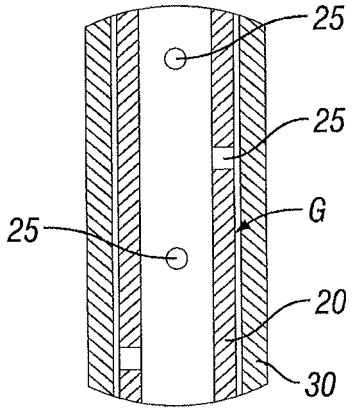
FIG. 1C is a partial view of the area shown in detail 1C in FIG. 1A.
Figure 1D:
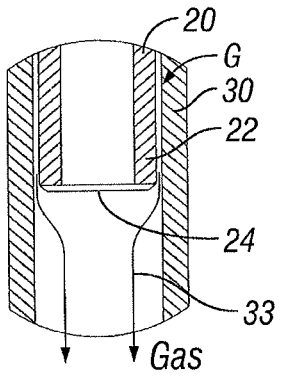
FIG. 1D is a partial view of the area shown in detail 1D in FIG. 1A.

In the embodiment shown, inner tube 20 is a substantially cylindrical member having a first end 21, a second end 22 and a longitudinally extending channel 23 running from first end 21 to second end 22. As shown in FIG. 1D, second end 22 is closed by a cap, seal or other means 24. As shown in FIG. 1C, a plurality of passageways or openings 25 extend through the side wall of inner tube 20. (Note that refractory 40 is not shown in FIGS. 1C and 1D) Inner tube 20 may be constructed from any one of a number of materials sufficient to withstand the operating conditions of the lance, such as, for example, steel.

In the embodiment shown, outer tube 30 is a substantially cylindrical member having a first end 31, a second end 32 and a longitudinally extending channel 33 running from first end 31 to second end 32. Outer tube 30 is open at second end 32. Outer tube 30 may be constructed from any one of a number of materials sufficient to withstand the operating conditions of the lance, such as, for example, steel. Inner tube 20 is positioned within outer tube 30 and sized such that there is a gap G between the side walls of inner tube 20 and outer tube 30.

Refractory 40 generally includes a first end 41, a second end 42 and a longitudinally extending channel 43 in which inner tube 20 and outer tube 30 are positioned. Refractory 40 further includes an outlet channel 44 having an opening 45 extending through the outermost extent of second end 42. Refractory 40 may be constructed from any one of a number of materials sufficient to withstand the operating conditions of the lance, such as, for example, a refractory material.

Lance 10 may be used, for example, to treat molten metal, such as, for example, steel or iron, by introducing gas into the molten metal bath during processing. To do so, gas is supplied from first end 21 of inner tube 20 into channel 23. Because channel 23 is closed by seal 24, gas cannot escape through second end 22 of inner tube 20 and pressure builds within channel 23. When the pressure of the gas in channel 23 builds to a sufficient level, gas will flow through openings 25 in inner tube 20 and into gap G between inner tube 20 and outer tube 30. Gas will continue to flow downwardly through gap G into channel 33 of outer tube 30. From there gas will flow through channel 44 in refractory 40 and out opening 45 as illustrated in FIGS. 1A and 1D. Lance 10 may be provided with seals at the appropriate junctures of the various components to prevent gas from escaping upwardly through lance 10.

FIGS. 2A-2D show an alternative embodiment of a lance according to the present invention. In this embodiment, a lance 110 generally includes an inner tube 120 and an outer tube 130 housed within a refractory 140. Lance 110 includes a first end 111 and a second 112.

Figure 2A:
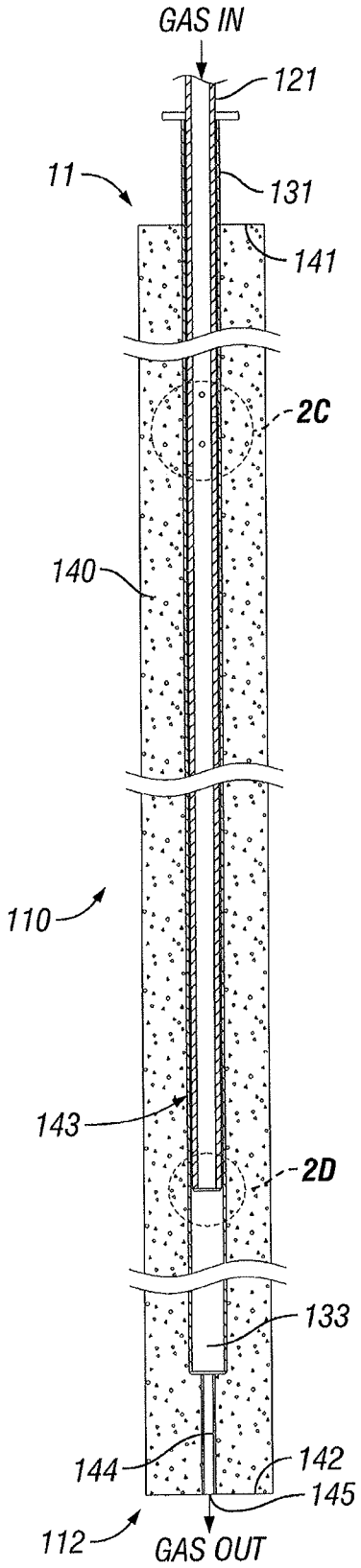
FIG. 2A is a longitudinal sectional view of a molten metal treatment lance according to another embodiment of the present invention.
Figure 2B:
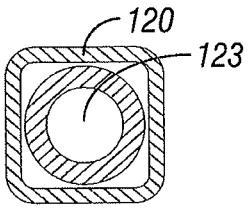
FIG. 2B is a cross-sectional view taken along line A-A in FIG. 2A.
Figure 2C:
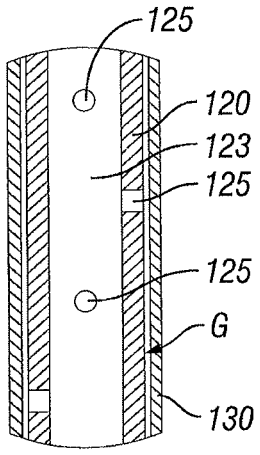
FIG. 2C is a partial view of the area shown in detail 2C in FIG. 2A.
Figure 2D:
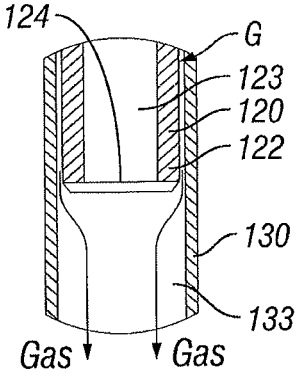
FIG. 2D is a partial view of the area shown in detail 2D in FIG. 2A.
Figure 3A:
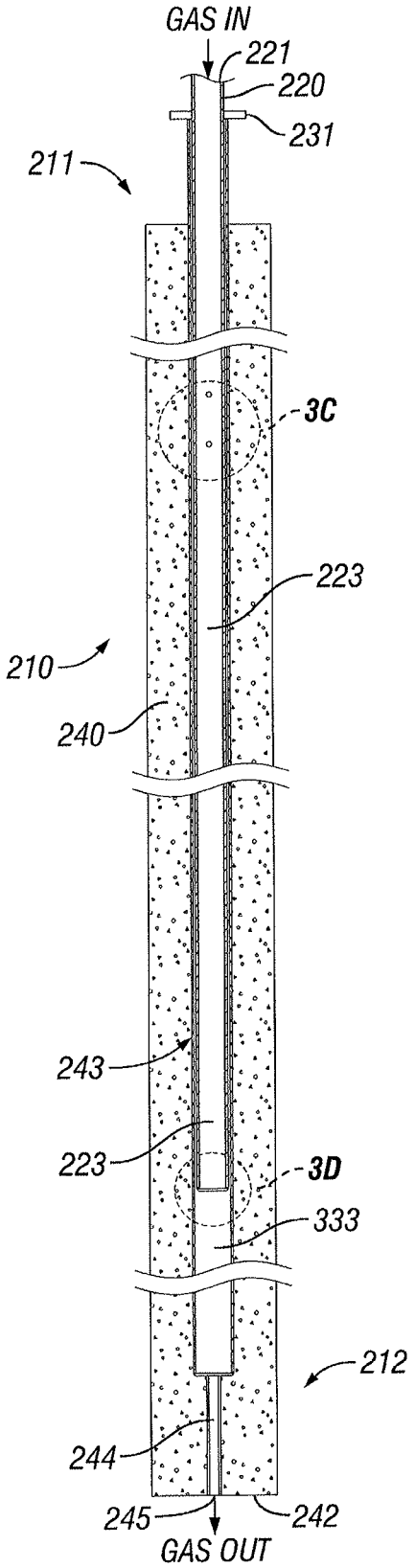
FIG. 3A is a longitudinal sectional view of a molten metal treatment lance according to another embodiment of the present invention.
Figure 3B:
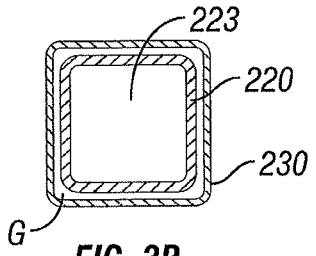
FIG. 3B is a cross-sectional view taken along line A-A in FIG. 3A.
Figure 3C:
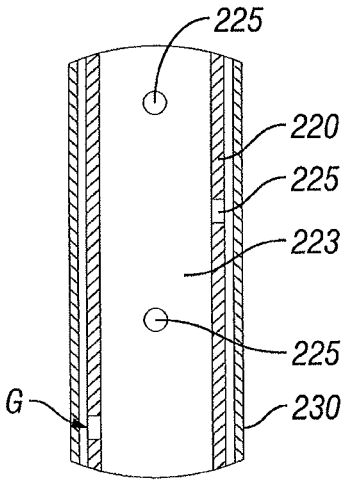
FIG. 3C is a partial view of the area shown in detail 3C in FIG. 3A.
Figure 3D:
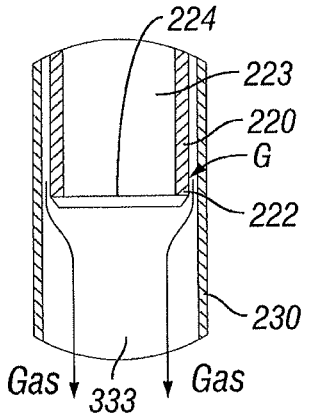
FIG. 3D is a partial view of the area shown in detail 3D in FIG. 3A.

In the embodiment shown, inner tube 120 is a substantially cylindrical member having a first end 121, a second end 122 and a longitudinally extending channel 123 running from first end 121 to second end 122. As shown in FIG. 2D, second end 122 is closed by a cap, seal or other means 124. As shown in FIG. 2C, a plurality of passageways or openings 125 extend through the side wall of inner tube 120. (Note that refractory 140 is not shown in FIGS. 2C and 2D) Inner tube 120 may be constructed from any one of a number of materials sufficient to withstand the operating conditions of the lance, such as, for example, steel.

In the embodiment shown, outer tube 130 has a substantially square cross-section having a first end 131, a second end 132 and a longitudinally extending channel 133 running from first end 131 to second end 132. Outer tube 30 is open at second end 132. Outer tube 130 may be constructed from any one of a number of materials sufficient to withstand the operating conditions of the lance, such as, for example, steel. Inner tube 120 is positioned within outer tube 130 and sized such that there is a gap G between the side walls of inner tube 120 and outer tube 130. Note that use of a square outer tube 130 results in a larger gap at the corners of outer tube 130 than at the midpoints along the side walls of outer tube 130.

Refractory 140 generally includes a first end 141, a second end 142 and a longitudinally extending channel 143 in which inner tube 120 and outer tube 130 are positioned. Refractory 140 further includes an outlet channel 144 having an opening 145 extending through the outermost extent of second end 142. Refractory 140 may be constructed from any one of a number of materials sufficient to withstand the operating conditions of the lance, such as, for example, a refractory material.

FIGS. 3A-3D show an alternative embodiment of a lance according to the present invention. In this embodiment, both inner tube 220 and outer tube 230 have a substantially square cross-section.

FIGS. 4A-4D illustrate a lance according to another embodiment of the present invention. In this embodiment, lance 310 generally includes a first inner tube 320A, a second inner tube 320B and an outer tube 330 housed within a refractory 340. Lance 310 includes a first end 311 and a second 312.

Figure 4A:
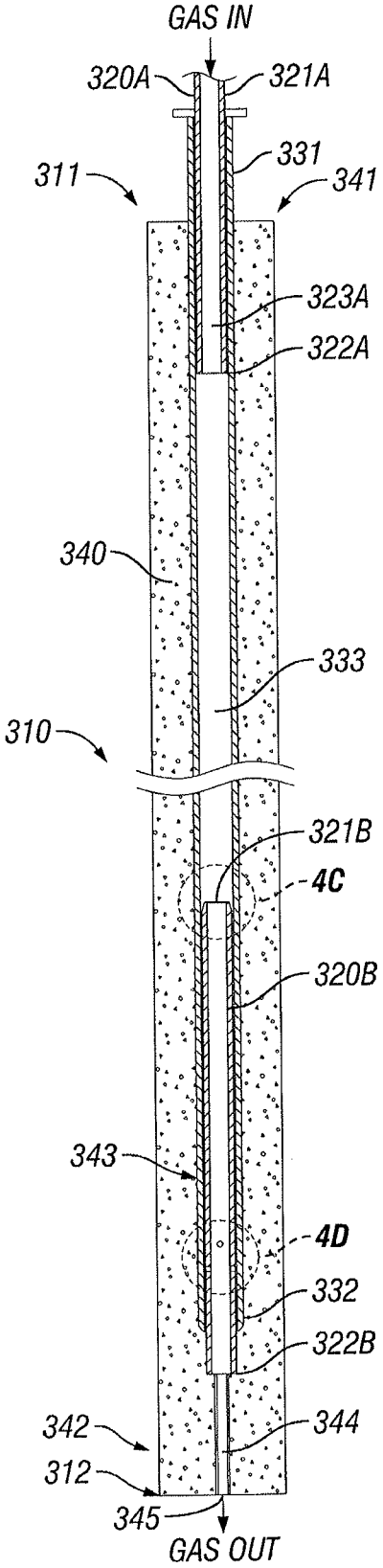
FIG. 4A is a longitudinal sectional view of a molten metal treatment lance according to another embodiment of the present invention.
Figure 4B:
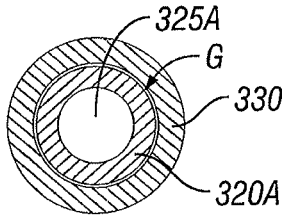
FIG. 4B is a cross-sectional view taken along line A-A in FIG. 4A.
Figure 4C:
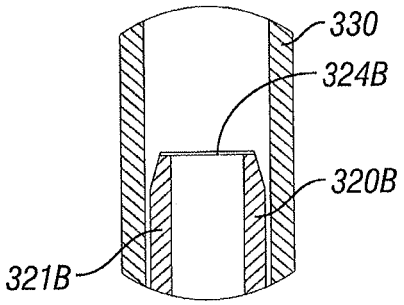
FIG. 4C is a partial view of the area shown in detail 4C in FIG. 4A.
Figure 4D:
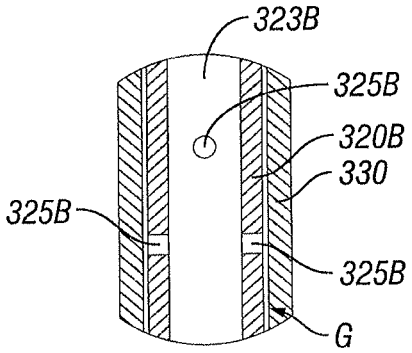
FIG. 4D is a partial view of the area shown in detail 4D in FIG. 4A.

In the embodiment shown, first inner tube 320A is a substantially cylindrical member having a first end 321A, a second end 322A and a longitudinally extending channel 323A running from first end 321A to second end 322A. Second end 322A of first inner tube 320A is open. Second inner tube 320B is a substantially cylindrical member having a first end 321B, a second end 322B and a longitudinally extending channel 323B running from first end 321B to second end 322B. As shown in FIG. 4C, first end 321B of second inner tube 320B is closed by a cap, seal or other means 324B. As shown in FIG. 4D, a plurality of passageways or openings 325B extend through the side wall of second inner tube 320B. (Note that refractory 340 is not shown in FIGS. 4C and 4D) Inner tubes 320A and 320B may be constructed from any one of a number of materials sufficient to withstand the operating conditions of the lance, such as, for example, steel.

In the embodiment shown, outer tube 330 is a substantially cylindrical member having a first end 331, a second end 332 and a longitudinally extending channel 333 running from first end 331 to second end 332. Note that in this embodiment second end 322B of second inner tube 320B extends beyond second end 332 of outer tube 330. Outer tube 330 may be constructed from any one of a number of materials sufficient to withstand the operating conditions of the lance, such as, for example, steel. First inner tube 320A and second inner tube 320B are positioned within outer tube 330 and sized such that there is a gap G between the side walls of both first and second inner tubes 320A and 320B and outer tube 330.

Refractory 340 generally includes a first end 341, a second end 342 and a longitudinally extending channel 343 in which first inner tube 320A, second inner tube 320B and outer tube 330 are positioned. Refractory 340 further includes an outlet channel 344 having an opening 345 extending through the outermost extent of second end 342. Refractory 340 may be constructed from any one of a number of materials sufficient to withstand the operating conditions of the lance, such as, for example, a refractory material.

Gas may be supplied from first end 321A of first inner tube 320A, into channel 323A and out second end 321B into channel 333 of outer tube 330. Because first end 321B of second inner tube 320B is closed by seal 324B, gas will flow around the outside of second inner tube 320B, into gap G and into channel 323B through openings 325B. From there the gas will flow out second end 322B of second inner tube 320B, into channel 344 and out opening 345 in refractory 340. Lance 310 may be provided with seals at the appropriate junctures of the various components to prevent gas from escaping upwardly through lance 310.

FIGS. 5A-5D illustrate a lance according to another embodiment of the present invention. In this embodiment, lance 410 generally includes a first inner tube 420A, a second inner tube 420B and an outer tube 430 housed within a refractory 440. Lance 410 includes a first end 411 and a second 412.

Figure 5A:
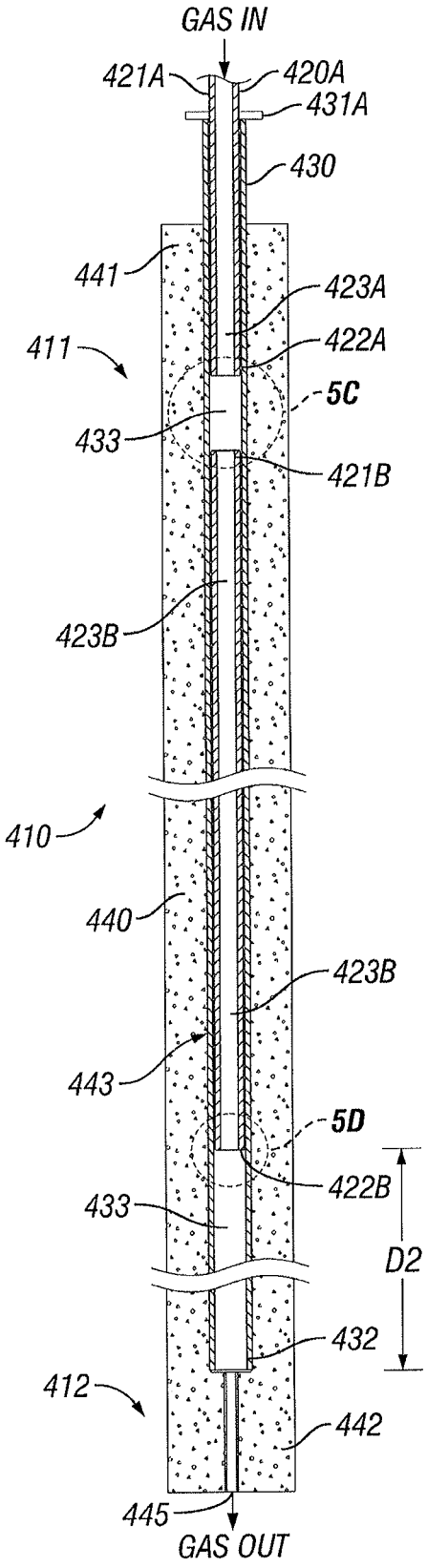
FIG. 5A is a longitudinal sectional view of a molten metal treatment lance according to another embodiment of the present invention.
Figure 5B:
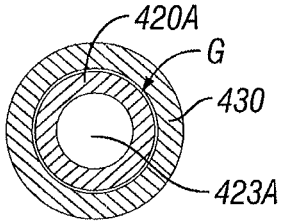
FIG. 5B is a cross-sectional view taken along line A-A in FIG. 5A.
Figure 5C:
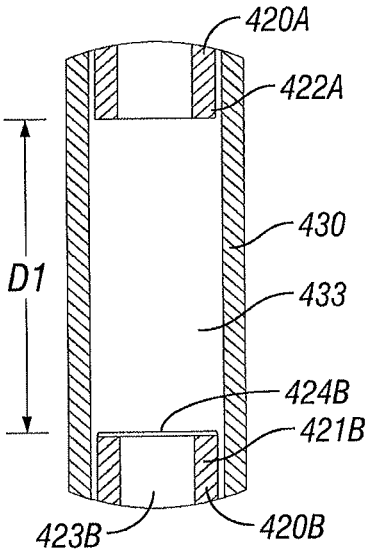
FIG. 5C is a partial view of the area shown in detail 5C in FIG. 5A.
Figure 5D:
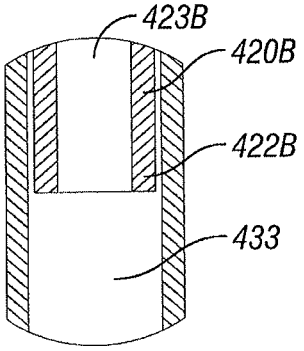
FIG. 5D is a partial view of the area shown in detail 5D in FIG. 5A.

In the embodiment shown, first inner tube 420A is a substantially cylindrical member having a first end 421A, a second end 422A and a longitudinally extending channel 423A running from first end 421A to second end 422A. Second end 422A of first inner tube 420A is open. Second inner tube 420B is a substantially cylindrical member having a first end 421B, a second end 422B and a longitudinally extending channel 423B running from first end 321B to second end 422B. As shown in FIG. 5C, first end 421B of second inner tube 320B is closed by a cap, seal or other means 424B. (Note that refractory 440 is not shown in FIGS. 5C and 5D) Inner tubes 420A and 420B may be constructed from any one of a number of materials sufficient to withstand the operating conditions of the lance, such as, for example, steel.

In the embodiment shown, outer tube 430 is a substantially cylindrical member having a first end 431, a second end 432 and a longitudinally extending channel 433 running from first end 431 to second end 432. Outer tube 430 may be constructed from any one of a number of materials sufficient to withstand the operating conditions of the lance, such as, for example, steel. First inner tube 420A and second inner tube 420B are positioned within outer tube 430 and sized such that there is a gap G between the side walls of both first and second inner tubes 420A and 420B and outer tube 430.

Refractory 440 generally includes a first end 441, a second end 442 and a longitudinally extending channel 443 in which first inner tube 420A, second inner tube 420B and outer tube 430 are positioned. Refractory 440 further includes an outlet channel 444 having an opening 445 extending through the outermost extent of end 442. Refractory 440 may be constructed from any one of a number of materials sufficient to withstand the operating conditions of the lance, such as, for example, a refractory material.

In this embodiment of the invention, the position of second inner tube 420B within channel 433 may be adjusted to change the distance D1 between second end 422A of first inner tube 420A and first end 421B of second inner tube 420B. Repositioning of second inner tube 420B causes a corresponding change in the distance D2 between second end 422B of second inner tube 420B and second end 432 of outer tube 430. The larger the distance D1, the greater cooling of the lance in that area that is caused by the gas fed to the lance. The same is true with respect to distance D2.

Gas may be supplied from first end 421A of first inner tube 420A, into channel 423A and out second end 421B into channel 433 of outer tube 430. Because channel 423B of second inner tube 420B is closed by seal 424B, gas will flow around the outside of second inner tube 420B, into gap G and into channel 433 below second end 422B of second inner tube 420B. From there the gas will flow into channel 444 and out opening 445 in Refractory 440. Lance 410 may be provided with seals at the appropriate junctures of the various components to prevent gas from escaping upwardly through lance 410.

FIGS. 6A-6D illustrate another embodiment of the present invention that can be used to introduce both gas and powder additives to the molten metal during processing. Lance 510 generally includes an inner tube 520 and an outer tube 530 housed within a refractory 540. Lance 510 includes a first end 511 and a second 512.

Figure 6A:
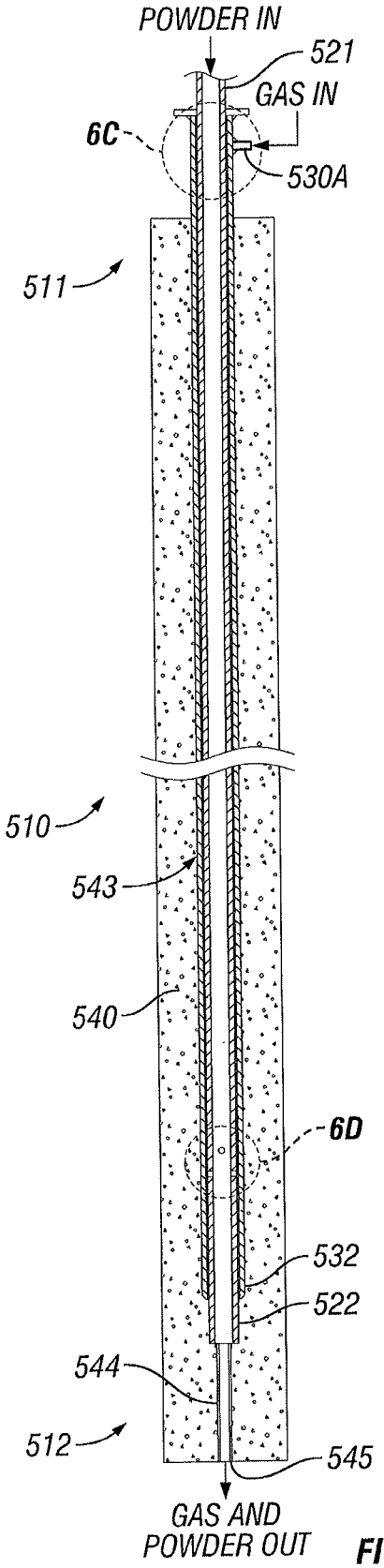
FIG. 6A is a longitudinal sectional view of a molten metal treatment lance according to another embodiment of the present invention.
Figure 6B:
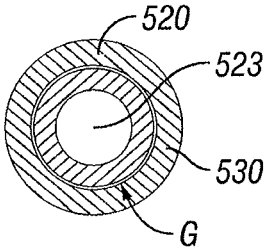
FIG. 6B is a cross-sectional view taken along line A-A in FIG. 6A.
Figure 6C:
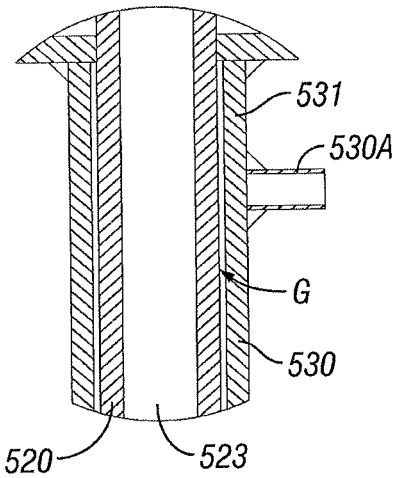
FIG. 6C is a partial view of the area shown in detail 6C in FIG. 6A.
Figure 6D:
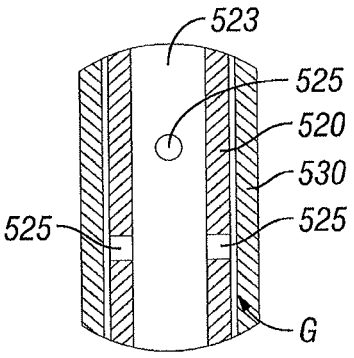
FIG. 6D is a partial view of the area shown in detail 6D in FIG. 6A.
Figure 7A:
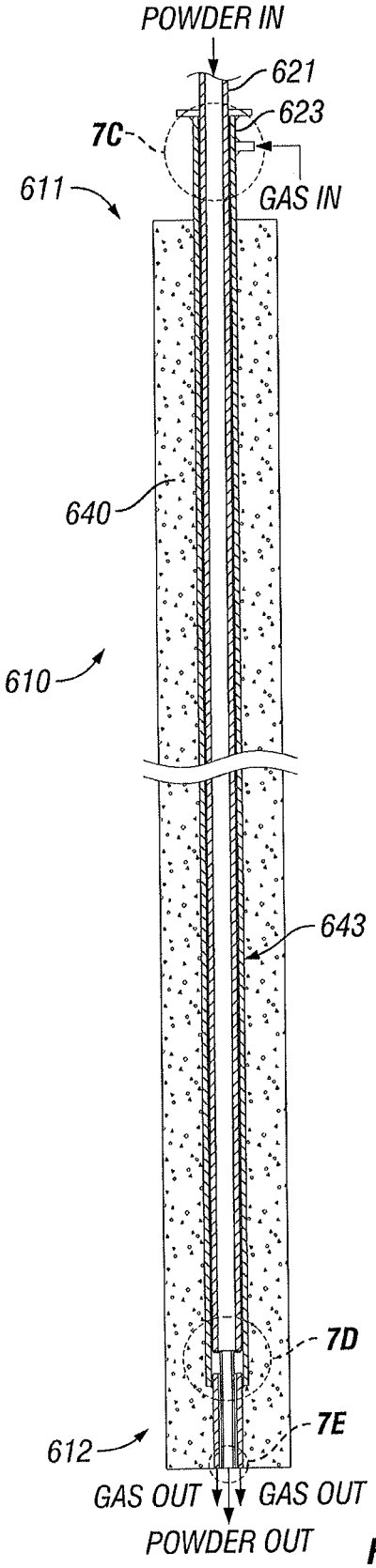
FIG. 7A is a longitudinal sectional view of a molten metal treatment lance according to another embodiment of the present invention.
Figure 7B:
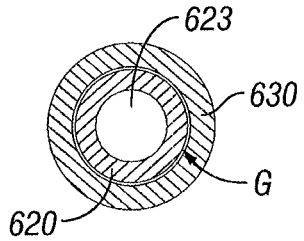
FIG. 7B is a cross-sectional view taken along line A-A in FIG. 7A.
Figure 7C:
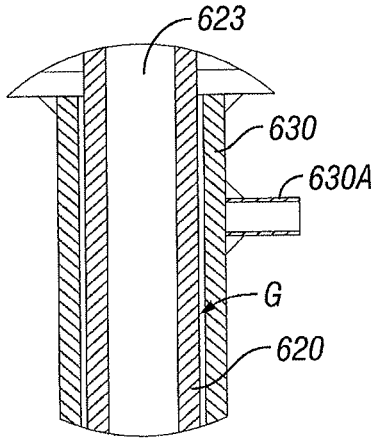
FIG. 7C is a partial view of the area shown in detail 7C in FIG. 7A.
Figure 7D:
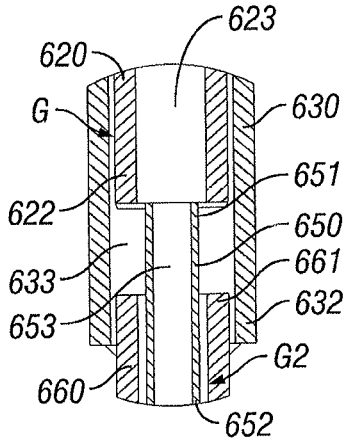
FIG. 7D is a partial view of the area shown in detail 7D in FIG. 7A.
Figure 7E:
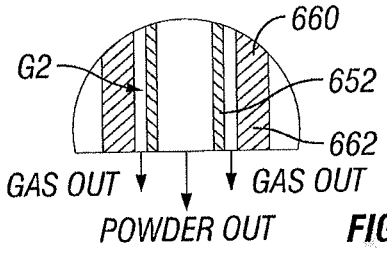
FIG. 7E is a partial view of the area shown in detail 7E in FIG. 7A.

In the embodiment shown, inner tube 520 is a substantially cylindrical member having a first end 521, a second end 522 and a longitudinally extending channel 523 running from first end 521 to second end 522. Second end 522 of inner tube 520 extends past second end 532 of outer tube 530 and opens into channel 544 of refractory 540. As shown in FIG. 6D, a plurality of passageways or openings 525 extend through the side wall of inner tube 520. (Note that refractory 540 is not shown in FIGS. 6C and 6D) Inner tube 520 may be constructed from any one of a number of materials sufficient to withstand the operating conditions of the lance, such as, for example, steel.

In the embodiment shown, outer tube 530 is a substantially cylindrical member having a first end 531, a second end 532 and a longitudinally extending channel 533 running from first end 531 to second end 532. Outer tube 530 further includes an inlet or port 530A that communicates with gap G between inner tube 520 and outer tube 530. Outer tube 530 may be constructed from any one of a number of materials sufficient to withstand the operating conditions of the lance, such as, for example, steel.

Refractory 540 generally includes a first end 541, a second end 542 and a longitudinally extending channel 543 in which inner tube 520 and outer tube 530 are positioned. Refractory 540 further includes an outlet channel 544 having an opening 545 extending through the outermost extent of end 542. Refractory 540 may be constructed from any one of a number of materials sufficient to withstand the operating conditions of the lance, such as, for example, a refractory material.

Any desired additives, such as various powder additives that are used in processing molten metals, may be introduced to lance 510 through channel 523 of inner tube 520. The additives will flow downwardly into channel 544 and out opening 545 of refractory 540. Gas may also be introduced to lance 510 through port 530A, from which it will flow into gap G through openings 525 in inner tube 520 and into channel 523, where it will mix with the additives and exit lance 510. Lance 510 may be provided with seals at the appropriate junctures of the various components to prevent gas from escaping upwardly through lance 510.

FIGS. 7A-7D illustrate a lance according to another embodiment of the present invention. Lance 610 generally includes an inner tube 620, an outer tube 630, a third tube 650 and a fourth tube 660, housed within a refractory 640. Lance 610 includes a first end 611 and a second 612.

In the embodiment shown, inner tube 620 is a substantially cylindrical member having a first end 621, a second end 622 and a longitudinally extending channel 623 running from first end 621 to second end 622. Inner tube 620 may be constructed from any one of a number of materials sufficient to withstand the operating conditions of the lance, such as, for example, steel.

In the embodiment shown, outer tube 630 is a substantially cylindrical member having a first end 631, a second end 632 and a longitudinally extending channel 633 running from first end 631 to second end 632. Outer tube 630 further includes an inlet or port 630A that communicates with gap G between inner tube 620 and outer tube 630. Outer tube 630 may be constructed from any one of a number of materials sufficient to withstand the operating conditions of the lance, such as, for example, steel.

Refractory 640 generally includes a first end 641, a second end 642 and a longitudinally extending channel 643 in which inner tube 620 and outer tube 630 are positioned. Refractory 640 further includes an outlet channel 644 having an opening 645 extending through the outermost extent of end 642. Refractory 640 may be constructed from any one of a number of materials sufficient to withstand the operating conditions of the lance, such as, for example, a refractory material.

Third tube 650 has first end 651 connected to second end 622 of inner tube 620 and a second end 652 terminating at second end 642 of refractory 640. Tube 650 further includes a longitudinally extending channel 653 in communication with channel 623 of inner tube 620. A fourth tube 660 has a first end 661 positioned within channel 633 of outer tube 630 and secured to second end 632 of outer tube 630. Tube 660 further includes a second end 662 that terminates at second end 642 of refractory 640. Tube 650 is positioned within tube 660 so as to form a second gap G2 between the side walls thereof.

Any desired additives, such as various powder additives that are used in processing molten metals, may be introduced to lance 610 through channel 623 of inner tube 620. The additives will flow downwardly into channel 653 and out opening 645 of refractory 640. Gas may also be introduced to lance 610 through port 630A, from which it will flow into gap G, into the space between second end 622 of inner tube 620 and first end 661 of tube 660, into gap G2 and exit lance 610. Lance 610 may be provided with seals at the appropriate junctures of the various components to prevent gas from escaping upwardly through lance 610.

Although the present invention has been shown and described in detail the same is by way of illustration only and not intended as a limitation on the invention. Various modifications of the disclosed embodiments are encompassed by the invention. For example, it is not necessary that gas and/or powder exit the lance from the lowermost surface of the refractory. The channels in the refractory can be configured such that gas and/or powder exit from a location above the lowermost surface of the refractory, such as horizontally from the side of the refractory. The channel from which gas and/or powder exit may extend vertically, horizontally or at an angle. More than one channel through which gas and/or powder exit may be included in certain embodiments of the invention.

What is claimed is:

1. A treatment lance, including:

a refractory having a first end, a second end, an opening through which matter exits the refractory and a channel extending from the first end to the opening;

a tubular member located at least partially in the channel of the refractory, the tubular member having a first end, a second closed end and a side wall extending between the first and second ends and defining a channel, the side wall having an inner surface, an outer surface and at least one opening extending through the sidewall to create a flow path for matter through the side wall of the tubular member to the opening in the refractory; and a second tubular member located at least partially in the channel of the refractory, the second tubular member having a channel in which the tubular member is at least partially located, wherein the second tubular member has a first end and a second end located in the channel of the refractory between the first and second ends of the refractory.

2. The treatment lance according to claim 1, wherein the opening in the refractory extends through the outermost extent of the second end of the refractory.

3. The treatment lance according to claim 1, wherein the refractory further includes a sidewall extending from the first end of the refractory to the second end of the refractory and the opening in the refractory extends through the sidewall of the refractory.

4. The treatment lance according to claim 1, wherein the opening in the refractory is located adjacent the second end of the refractory.

5. The treatment lance according to claim 1, wherein the flow path extends from the channel of the second tubular member, through the opening in the sidewall of the tubular member, to the channel of the tubular member and to the opening in the refractory.

6. The treatment lance according to claim 1, wherein the flow path extends from the channel of the tubular member, through the opening in the sidewall of the tubular member, to the channel of the second tubular member and to the opening in the refractory.

7. The treatment lance according to claim 1, wherein the closed end of the tubular member is located farther from the opening in the refractory than is the first end of the tubular member.

8. The treatment lance according to claim 1, wherein the closed end of the tubular member is located closer to the opening in the refractory than is the first end of the tubular member.

9. A treatment lance, including:

a refractory having a first end, a second end and an opening through which matter exits the refractory;

a tubular member located at least partially within the refractory, the tubular member having a first end, a second end and a side wall extending between the first and second ends and defining a channel, the side wall having an inner surface, an outer surface and at least one opening extending through the side wall; and a second tubular member located at least partially in the refractory, the second tubular member having a first sealed end, a second sealed end located between the first and second ends of the refractory and a sidewall extending from the first sealed end to the second sealed end to form a sealed chamber in which the tubular member is at least partially located.

10. The treatment lance according to claim 9, wherein the opening in the refractory extends through the outermost extent of the second end of the refractory.

11. The treatment lance according to claim 9, wherein the refractory further includes a sidewall extending from the first end of the refractory to the second end of the refractory and the opening in the refractory extends through the sidewall of the refractory.

12. The treatment lance according to claim 9, wherein the second end of the tubular member extends beyond the second sealed end of the second tubular member.

13. The treatment lance according to claim 9, wherein the at least one opening extending through the side wall of the tubular member is located within the sealed chamber of the second tubular member.

* * * * *